US010906104B2

(12) United States Patent
Kumar et al.

(10) Patent No.: US 10,906,104 B2
(45) Date of Patent: Feb. 2, 2021

(54) SYSTEMS AND METHODS OF FABRICATION AND USE OF WEAR-RESISTANT MATERIALS

(71) Applicant: National Oilwell DHT, L.P., Conroe, TX (US)

(72) Inventors: Biju Pillai Kumar, Pasadena, TX (US); Bradley S. Ivie, Conroe, TX (US); Wei Liu, Conroe, TX (US); Anil Kumar, Conroe, TX (US); Russell C. Gilleylen, Spring, TX (US); Michael D. Hughes, Spring, TX (US); Jagdish Narayan, Raleigh, NC (US)

(73) Assignee: NATIONAL OILWELL DHT, L.P., Conroe, TX (US)

( * ) Notice: Subject to any disclaimer, the term of this patent is extended or adjusted under 35 U.S.C. 154(b) by 63 days.

(21) Appl. No.: 16/064,450

(22) PCT Filed: Jan. 27, 2017

(86) PCT No.: PCT/US2017/015274

§ 371 (c)(1),
(2) Date: Jun. 20, 2018

(87) PCT Pub. No.: WO2017/132471

PCT Pub. Date: Aug. 3, 2017

(65) Prior Publication Data

US 2019/0022759 A1 Jan. 24, 2019

Related U.S. Application Data

(60) Provisional application No. 62/288,049, filed on Jan. 28, 2016.

(51) Int. Cl.
*B22F 7/06* (2006.01)
*E21B 10/567* (2006.01)
(Continued)

(52) U.S. Cl.
CPC ..... *B22F 7/06* (2013.01); *B22D 25/06* (2013.01); *B22F 5/00* (2013.01); *C22C 37/10* (2013.01);
(Continued)

(58) Field of Classification Search
CPC .. B22F 7/06; B22F 2302/406; C23C 14/0617; C23C 16/27
(Continued)

(56) References Cited

U.S. PATENT DOCUMENTS 5,143,523 A 9/1992 Matarrese
5,755,299 A 5/1998 Langford, Jr. et al.
(Continued)

OTHER PUBLICATIONS

PCT/US2017/015274 International Search Report and Written Opinion dated Jun. 15, 2017 (16 p.).
(Continued)

*Primary Examiner* — Archene A Turner
(74) *Attorney, Agent, or Firm* — Conley Rose, P.C.

(57) ABSTRACT

Discussed herein are systems and methods of forming hardfacing coatings and films containing Q-carbon diamond particles for use in downhole drilling tooling and other tools where wear-resistant coating is desirable. The Q-carbon diamond-containing layers may be coated with matrix material and/or disposed in a matrix to form the coating, or the Q-carbon diamond layer may be formed directly from a diamond-like-carbon on a substrate.

8 Claims, 15 Drawing Sheets

(51) Int. Cl.

| | |
|---|---|
| ***C22C 37/10*** | (2006.01) |
| ***B22D 25/06*** | (2006.01) |
| ***C23C 4/129*** | (2016.01) |
| ***B22F 5/00*** | (2006.01) |
| ***E21B 10/46*** | (2006.01) |
| *E21B 10/50* | (2006.01) |
| *E21B 10/55* | (2006.01) |

(52) U.S. Cl.
CPC ..... *C23C 4/129* (2016.01); *E21B 10/46* (2013.01); *E21B 10/567* (2013.01); *B22F 2005/001* (2013.01); *B22F 2302/406* (2013.01); *E21B 10/50* (2013.01); *E21B 10/55* (2013.01)

(58) Field of Classification Search
USPC ..... 428/332, 408, 698
See application file for complete search history.

(56) References Cited

U.S. PATENT DOCUMENTS

| | | | | |
|---|---|---|---|---|
| 6,045,440 | A | 4/2000 | Johnson et al. | |
| 6,541,115 | B2 * | 4/2003 | Pender | C04B 41/009 428/408 |
| 8,079,428 | B2 | 12/2011 | Lyons et al. | |
| 8,322,466 | B2 | 12/2012 | Bird | |
| 2006/0191723 | A1 * | 8/2006 | Keshavan | E21B 10/5676 175/374 |
| 2010/0275523 | A1 * | 11/2010 | Tank | C04B 35/65 51/307 |
| 2011/0132667 | A1 * | 6/2011 | Smallman | B24D 99/005 428/215 |
| 2011/0162751 | A1 | 7/2011 | Fitzgerald et al. | |
| 2013/0209183 | A1 | 8/2013 | Chuo et al. | |
| 2018/0100234 | A1 | 4/2018 | Zhan et al. | |
| 2018/0371844 | A1 * | 12/2018 | Bao | E21B 10/573 |

OTHER PUBLICATIONS

Wikipedia, "Nanostructure" Dec. 27, 2015, pp. 1-2, URL: https:llen.wikipedia.org/w/index.php?title=Nanostructure&oldid=696980927 (1 p.).

Narayan, Jagdish, et al., "Novel Phase of Carbon, Ferromagnetism, and Conversion into Diamond," Journal of Applied Physics, vol. 118, No. 21503, Dec. 2, 2015 (13 p.).

Narayan, Jagdish, et al., "Research Update: Direct Conversion of Amorphous Carbon into Diamond at Ambient Pressures and Temperatures in Air," APL Materials, vol. 3, No. 100702 (2015) (12 p.).

Shipman, Matt, "Researchers Find New Phase of Carbon, Make Diamond at Room Temperature," Nov. 30, 2015, https://phys.org/news/2015-11-phase-carbon-diamond-room-temperature.html (3 p.).

Crowell, Maddy, "A Replacement for Diamonds? Scientists Discover Q-Carbon," Dec. 3, 2015, https://www.csmonitor.com/Science/2015/1203/A-replacement-for-diamonds-Scientists-discover-Q-carbon (3 p.).

Hughes, Clyde, "Q-Carbon Harder than Diamonds: New Carbon Material Created in Lab," Dec. 4, 2015, https://www.newsmax.com/TheWire/q-carbon-harder-diamonds/2015/12/04/id/704542/ (2 p.).

Bromwich, Jonah Engel, "New Substance is Harder than Diamond, Scientists Say," Dec. 3, 2015, https://www.nytimes.com/2015/12/03/science/q-carbon-harder-than-diamond.html?_r=0.

Wikipedia, "Q-carbon," accessed Jun. 19, 2018, https://en.wikipedia.org/wiki/Q-carbon#cite_ref-nyt_5-0 (3 p.).

Wei-Haas, Maya, "Weird New Type of Carbon is Harder (and Brighter) Than Diamond," Dec. 2, 2015, https://www.smithsonianmag.com/science-nature/weird-new-type-carbon-harder-brighter-than-diamond-180957433/?no-ist (2 p.).

Mack, Eric, Scientists Create New Kind of Diamond at Room Temperature, Nov. 30, 2015, https://www.forbes.com/sites/ericmack/2015/11/30/scientists-create-new-kind-of-diamond-at-room-temperature/#3a20dde14f77 (2 p.).

Brumfield, Ben, "Diamonds, Move Over: Scientists Make Harder, Brighter Q-Carbon," Dec. 3, 2015, https://www.cnn.com/2015/12/01/tech/super-diamond-q-carbon-scientists-laser/index.html.

Gogotsi, Yury, "Nanodiamonds for Drug Delivery Applications," accessed Jun. 20, 2018, http://nano.materials.drexel.edu/research/nanodiamonds-for-drug-delivery-applications/ (3 p.).

"Q&A: The Hardest Substance," Oct. 26, 2011, Department of Physics, University of Illinois at Urbana-Champaign, https://van.physics.illinois.edu/qa/listing.php?id=613 (2 p.).

Delacey, Lynda, "Q-Carbon: A New Phase of Carbon so Hard it Forms Diamonds when Melted," Dec. 7, 2015, https://newatlas.com/q-carbon-new-phase-of-carbon/40668/ (3 p.).

* cited by examiner

SYSTEMS AND METHODS OF FABRICATION AND USE OF WEAR-RESISTANT MATERIALS

CROSS-REFERENCED TO RELATED APPLICATIONS

This application is a 35 U.S.C. § 371 national stage application of PCT/US2017/015274 filed Jan. 27, 2017, and entitled "Systems and Methods of Fabrication and Use of Wear-Resistant Materials," which claims priority to U.S. Provisional Patent Application No. 62/288,049, "Wear-Resistant Materials for Downhole Tools," filed Jan. 28, 2016, each being incorporated by reference herein in its entirety for all purposes.

BACKGROUND

The disclosure relates to wear-resistant materials suitable for use in forming a hardfacing or other wear-resistant cladding on a surface, such as a downhole tool surface. The disclosure relates to wear-resistant materials having anti-balling properties. The disclosure relates to wear-resistant materials suitable for making cutting elements.

In drilling of oil and gas wells, downhole tools having surfaces that are exposed to the well environment or that interact with formations typically have to be made from or coated or modified with materials that are resistant to one or both of wear and balling.

Hardfacing belongs to a class of materials frequently used to protect downhole tools from abrasive wear. Hardfacing typically incorporates particles of a hard material into a metal matrix and is typically applied to a desired area of a tool by welding. Examples of downhole tools that may incorporate hardfacing include, but are not limited to, drill bits, reamers, and hole-openers.

Balling is a term used in drilling to describe clogging of drilling tools such as drill bits. To prevent balling, anti-balling coatings may be applied to the surfaces of the drilling tools. The anti-balling coatings contain agents that improve hydrophobicity of the surfaces on which they are applied. These agents can be mixed with hardfacing material to produce hardfacing with anti-balling properties.

BRIEF SUMMARY OF THE DISCLOSURE

In an embodiment, a component, comprising: a tungsten carbide substrate; a diamond layer formed on the tungsten carbide layer and comprising a plurality of diamond nanoparticles; and a Q-carbon layer formed on the diamond layer.

In an embodiment, a method of forming a hard-facing coating comprising: forming a homogenous mixture of Q-carbon and at least one additional component other than Q-carbon; and applying the homogenous mixture to a substrate, wherein applying the homogenous mixture to the substrate comprises one of: disposing the homogenous mixture in a laser beam path of a laser beam apparatus, wherein the homogenous mixture comprises a powder, and wherein the powder melts when disposed in the laser beam path to form a hardfacing coating on the substrate; and disposing the homogenous mixture in an oxy-acetylene thermal spraying apparatus and heating the homogeneous mixture using an oxy-acetylene torch of the oxy-acetylene thermal spraying apparatus.

In an alternate embodiment, A method of forming a hard-facing coating comprising: disposing a powder comprising Q-carbon diamond into at least one cavity of a mold; applying pressure to the mold; and forming, in response to pressure, a hardfacing component via the at least one cavity.

The foregoing general description and the following detailed description describe exemplary embodiments of the invention and are intended to provide an overview or framework for understanding the nature of the invention, the invention being defined solely by the claims below. The accompanying drawings are included to provide further understanding of the disclosed embodiments and are incorporated in and constitute a part of this specification. The drawings illustrate various exemplary embodiments of the invention and together with the description serve to explain the principles and operation of the disclosed embodiments.

BRIEF DESCRIPTION OF DRAWINGS

The following is a description of the figures in the accompanying drawings. The figures are not necessarily to scale, and certain figures and certain views of the figures may be shown exaggerated in scale or in schematic in the interest of clarity and conciseness.

DETAILED DESCRIPTION OF DISCLOSED EXEMPLARY EMBODIMENTS

Figure 1A:
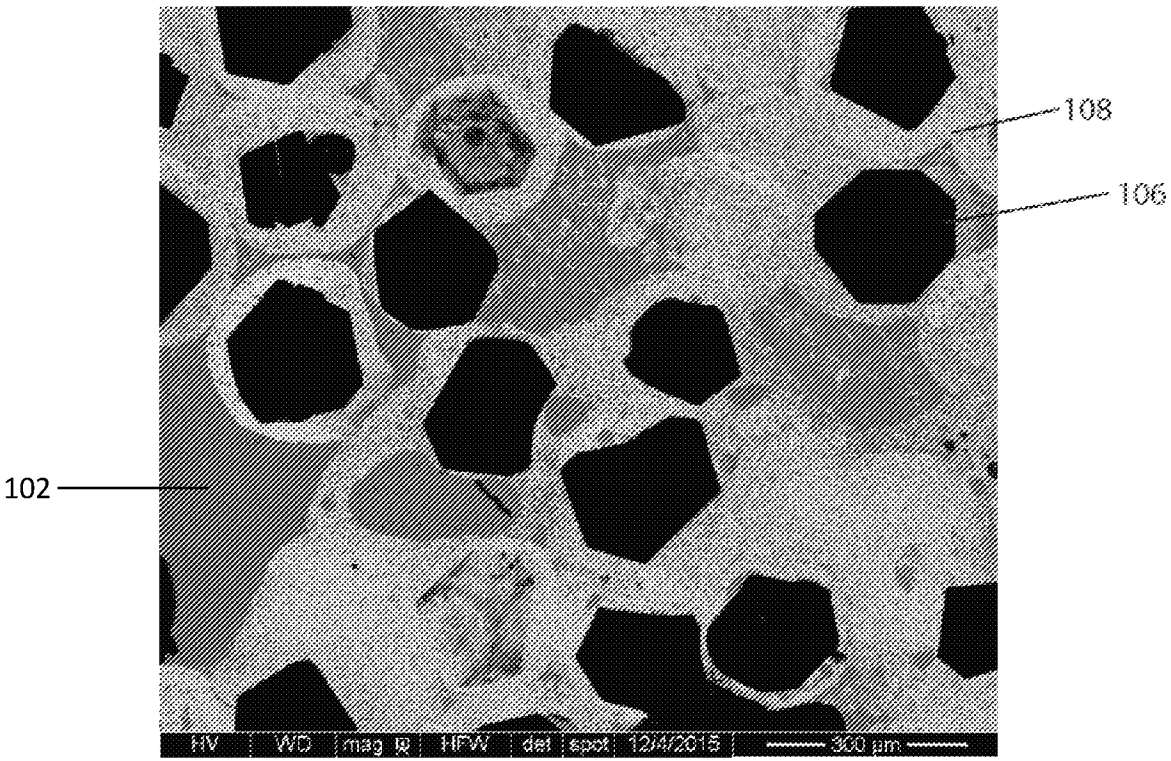
FIG. 1A shows a photomicrograph of a hardfacing fabricated according to certain embodiments of the present disclosure.

In the following detailed description, numerous specific details may be set forth in order to provide a thorough understanding of the embodiments that are being discussed herein. However, it will be clear to one skilled in the art that embodiments of the invention may be practiced without some or all of these specific details set out in the detailed description of these exemplary embodiments. In other instances, well-known features or processes may not be described in detail so as not to unnecessarily obscure the description. In addition, like or identical reference numbers may be used to identify common or similar elements.

Definitions

"Q-carbon" is the name given to a new solid phase of carbon formed by quenching of super-undercooled state of liquid carbon. Q-carbon has an amorphous structure with a very high fraction of $sp^3$ bonded carbon (75% to 85%), with the remainder being $sp^2$ bonded carbon. Nanodiamonds and microdiamonds have been grown from Q-carbon, with possibility for growing other structures such as nanodots and nanorods. Q-carbon is harder than diamond-like carbon (e.g., 35 GPa for Q-carbon filaments compared to 21 GPa for diamond-like carbon) and possesses properties unknown to other carbon phases, such as ferromagnetism at room temperature.

Q-carbon can be synthesized at room temperature and atmospheric pressure without catalysts. In one procedure, synthesis of Q-carbon involves depositing films of amorphous diamond-like carbon (DLC) on a substrate. As used herein, a "film" may be a layer of coating that is less about 50 μm thick as measured outward from a substrate surface, in contrast to hardfacings which may thicker, in some cases the hardfacings may be from 300 nm to 600 nm thick as measured outwards from the substrate. A super-undercooled state of liquid carbon is produced by melting the amorphous carbon films using a nanosecond laser beam at about 4000K, for example, using ArF Excimer laser pulses for a pulse duration of 20 ns and energy density of 0.3 to 0.6 J $cm^{-2}$ to make such super-undercooled state. The super-undercooled state is then quenched to form Q-carbon. The Q-carbon will have a matrix of $sp^2$ and $sp^3$ bonded amorphous carbon, with $sp^3$ being the major hybridization. Diamond nanocrystals may be embedded in the Q-carbon matrix if an epitaxial template is provided for growth. The number density of the diamond nanocrystals will depend on the time available for crystal growth before quenching the super-undercooled state. A second laser pulse, e.g., at 0.6 J $cm^{-2}$ can be applied to the Q-carbon matrix to grow diamond nanocrystals and microcrystals by heterogeneous nucleation. The substrate may also be selected to grow special diamond forms such as nanoneedles, nanodots, microneedles, and microdots.

In this disclosure, the term "Q-carbon" will be used to describe a solid carbon phase produced by quenching of super-undercooled state of amorphous diamond-like carbon. Q-carbon has both $sp^a$ bonded carbon atoms and $sp^2$ bonded carbon atoms.

The term "Q-carbon powder" will be used to describe a powder comprised of a plurality of particles of Q-carbon material, these particles may be of varying sizes and size ranges.

The term "Q-carbon composite" will be used to describe a material that has both Q-carbon and an additional material such as a metal matrix or hard metal, e.g., when Q-carbon is used to form a coating along with at least one other component constituting the coating.

The term "Q-carbon material" will be used to describe a material made of one or more of Q-carbon, diamonds formed by quenching of super-undercooled state of amorphous diamond-like carbon into Q-carbon, and diamonds formed from Q-carbon.

The term "hardfacing" will be used to describe a coating formed on or applied to a material surface where the coating is harder and/or tougher than the material on which it is formed or applied. The hardfacing may be formed or applied by, for example, directly by laser welding, using an oxy-acetylene torch system, spin-coating, direct molding under heat and/or pressure.

The various coatings and powders used to form hardfacing and other coatings employed to prolong tool life discussed herein may be collectively referred to as "wear-resistant" materials and coatings interchangeably, with or without reference the specific composition and/or range of compositions discussed for a particular wear-resistant coating.

Using the systems and methods discussed herein, a hardfacing comprises Q-carbon and, in some embodiments, additional materials, may be employed and applied directly on a substrate. This substrate may comprise manual or automated tooling such as drill bits used in a variety of construction, assembly, and maintenance functions. In some embodiments, the substrate may comprise a tooling component that is coupled to another component. In still other embodiments, the substrate may comprise a polycrystalline diamond compact (PDC) table or element. In addition, components may be formed from the Q-carbon and Q-carbon-based particles and pastes such that these are stand-alone components, as opposed to coatings formed on a surface, and later coupled to tool bodies.

In a first example, a hardfacing comprises a Q-carbon powder or a Q-carbon powder combined with a matrix powder. In one example, a hard-facing may be formed from a plurality of hard-facing rods that are formed from Q-carbon powders, Q-carbon composites, and/or that have a matrix core surrounded by a Q-carbon or Q-carbon composite material. These rods may then be used to hard-face a drill bit or another downhole tool, either by coupling the rods to the drill bit or other structure or by melting the rods on to a surface or surfaces via laser or oxy-acetylene torch welding. In another example, the hardfacing may be formed from a powder directly on a PDC cutting element, and in yet another example, the wear-resistant material coating may be formed on cutting tips for use with various manual, automatic, robotic, and combination tools. In this example, the coating may be formed directly on the surface of the cutting tip which is then assembled to one or more tools.

In another embodiment, a hardfacing comprises Q-carbon powder or Q-carbon powder mixed with an at least one type and size of other material such as a matrix powder. In one embodiment, the Q-carbon powder has particle sizes in a range from 50 μm to 300 μm. In one embodiment, the Q-carbon powder may be at least 20% by volume of the total volume wear-resistant material. In another embodiment, the Q-carbon powder may be 20% to 60% by volume of the wear-resistant material. The matrix powder includes particles of one or more matrix materials, and may range in size from 20 μm-100 μm, and in other embodiments, from 50 μm-150 μm, or other ranges within those ranges of particle diameter. The matrix materials may be selected from metal matrix composites, alloy-based metal matrix composites, and ceramic matrix composites. In various embodiments, the matrix materials include, but are not limited to, powders of nickel- or cobalt-based matrix alloys, such as Ni—Si—B, Ni—Cr—B—Si—Fe, and Co—Cr—Ni; tungsten carbide/tungsten semicarbide ($WC/W_2C$) matrix; tungsten-carbide cobalt (WC/Co) matrix; chromium carbide ($Cr_3C_2$) matrix; silicon carbide (SiC) matrix; and nickel alum inate or cubic boron nitride. In one embodiment, the matrix powder may comprise 40% to 60% of the volume of the wear-resistant material.

In an alternate embodiment, a diamond-like carbon (DLC) may be used to form a Q-carbon coating. In this example, there is no Q-carbon powder, and the DLC will be converted to Q-carbon film, integrated to the substrate as a thin layer of film of less than 50 μm. During a laser annealing, the DLC film will be converted into Q-carbon coating, the thickness of Q-carbon film will be substantially similar to that of the DLC film. A super under cooling process performed for less than 60 nano-seoconds is employed in the formation of Q-carbon and Q-carbon diamond. In some embodiments, CVD may be employed for growing Q-carbon to Q-carbon diamond particle (0.5 nm to 50 microns range)

In another embodiment, a hardfacing is applied to a substrate, where the substrate may comprise a drill bit, a cutting tool, a PDC cutting element, or other substrates. In the hardfacing, particles of the Q-carbon powder are dispersed within a matrix formed by the particles of the matrix powder. The hardfacing may be formed by mixing the Q-carbon powder and the matrix powder such that each particle of the Q-carbon powder is coated with particles the matrix material(s). Then, the mixture can be deposited on a surface of the substrate using a welding technique to form the hardfacing, i.e., a layer on the surface of the substrate including a matrix in which particles of Q-carbon material are embedded. Examples of suitable welding techniques include, but are not limited to, laser, plasma transferred arc, and oxy-acetylene welding. In one embodiment, the material of the substrate is selected to allow metallurgical bonds to be formed between the wear-resistant material and the working surface of the substrate. The hardfacing can be formed on any of various downhole tools having surfaces subject to wear when used in a well environment, such as drill bits, stabilizers, and bore openers. These downhole tools have bodies that are typically made of steel or tungsten carbide.

Hardfacing Powders

In an embodiment, a Q-carbon powder may be mixed with Ni, or Co based matrix alloys like Ni—Si—B, Ni—Cr—B—Si—Fe, and Co—Cr—Ni. In alternate embodiments, the Q-carbon powder may be combined with WC and/or $W_2C$, $Cr_3C_2$, a Silicon Carbide matrix, Ni Aluminate or Cubic Boron Nitride, or combinations thereof. Each particle of the Q-carbon is coated (encompassed) by a plurality of particles of the matrix material via electroless nickel cladding, chemical vapor deposition (CVD), pressure vapor deposition (PVD) or other known methods. In an embodiment, the particles of Q-carbon prior to coating may range from 50 μm to 300 μm, and the thickness of the matrix material in which the Q-carbon particles are disposed may comprise 0.5 mm to 3 mm, thus the hardfacing may also range from 0.5 mm to 3 mm thick, as measured outward from the surface. As discussed herein, making a Q-carbon powder or paste may comprise first coating each particle of the Q-carbon with a plurality of particles, as discussed in detail below.

The premixed powders may be applied by Laser, plasma-transferred arc (PTA), or Oxy-acetylene process on steel bits like Tektonic™, stabilizers, bore openers or downhole tools to improve abrasion/erosion resistance. In an embodiment using PTA, the premixed powders were injected into the system by either coaxial or lateral nozzles. The interaction of the metallic powder stream and the laser causes melting to occur and the powder to be deposited onto the substrate. Moving the substrate allows the melted powder to solidify and thus produces a track of solid metal overlay. The metallurgical bond between the overlay and the substrate provides high resistance against corrosion and high bond strength. The injection process must ensure that there is no segregation of the hard phase and matrix powders during application.

In an embodiment, the powders may be mixed immediately prior to use, and in other embodiments the powders may be premixed. In one example, the powder is mixed by rotating the powder vessel 180° in opposite directions from 10-100 times (cycles, where each cycle comprises a rotation in each 180° direction) prior to disposing the powder into the dispenser. All of the powders (Q-carbon, Q-carbon plus WC, metal matrix, etc.) were mixed by volume ratio and then poured into the powder holder of the gun and stirred again before spraying was commenced. Before spraying the coating, the surface of the substrate was grit blasted with silicon carbide grit. The surface was pre-heated (placed in the flame without any application of powder). An interlayer comprising diamond, metals, and/or a metal matrix powder may be sprayed on the substrate in order to facilitate better bonding between the diamond coating and the substrate and to help prevent oxidation of the substrate surface. Then the diamond coating was formed on the surface of the work-piece using oxy-acetylene thermal spraying apparatus.

Hardfacing Rods

In another embodiment, a wear-resistant coating may be established via a configuration of rods that may be used to hard-face drilling bits and other downhole tools. In one example, a Q-carbon powder in size range from 1 μm to about 600 μm is mixed with at least one low-melting matrix alloy such as Ni—Si—B or Ni—Cr—B—Si—Fe. The Q-carbon powder and matrix alloy may be pressed to produce a hardfacing rod as shown in the following picture. Q-carbon may have refractory metals coatings like TiC or other transition metals to protect against oxidation, and may be coated by metal matrix like Ni-based material or by hard metals like WC—Co. In some embodiments, methods like electroless nickel cladding, CVD, and PVD may be used to form the wear-resistant coating. In this example, a Q-carbon composite were disposed as brazing rods onto a substrate that was heated to about 300° C. using a neutral oxygen-acetylene flame. In an alternate embodiment, the hardfacing rods may be melted on to a surface or surfaces to form a hardfacing, this may be via laser welding or by using an oxy-acetylene torch.

Impregnanted Coatings

An impregnated matrix blend may be formed by mixing Q-carbon, tungsten carbide powders, methylcellulose, carbonyl iron, and distilled water to make the material for diamond impregnated cutting structures of drill bits, this material may be referred to as a "paste." In one example, a Q-carbon powder of 300 μm to 1000 μm in size may be used. The mixed paste may be coupled to bit blade top to improve abrasion resistance and heated in a mold comprising both the paste, which may have been previously thermally processed, as well as at least a portion of a drill bit (or other component) such as the bit blade. This is referred to as the "impregnation" method since the paste is thermally processed in the same mold as the substrate (drill bit) to form the component comprising the hardfacing, as opposed to other methods where the coating is applied via a laser, arc-welder, or a physical/chemical connection as in the embodiment with the hardfacing rods.

Coating Q-Carbon Particles

In an embodiment, a hardfacing includes Q-carbon powder with particles having sizes ranging from 5 nm to 50 μm. Two or more layers of the wear-resistant material with $sp^2/sp^3$ bonded carbon content in a ratio of 20/80 to 50/50 can be used to form a hardfacing with improved erosion resistance. The Q-carbon powder can be blended with the one or more nickel or chrome alloys, and the Q-carbon and nickel/chrome alloy can be co-deposited on a metallic surface, for example, from a chemical bath, to form a hardfacing on the surface. The hardfacing would then include a nickel or chrome alloy(s) layer with particles of Q-carbon dispersed in the layer. Nickel may act as substrate for bonding, while chrome can impart anti-balling properties to the wear-resistant material.

In another embodiment, the hardfacing material may include electroless plating a nickel phosphorous based composite to allow use of electroless nickel plating in forming the hardfacing a surface. Electroless nickel plating comprises the deposition of a nickel-phosphorus alloy onto a metal substrate without the use of an electrical current. The electroless nickel plating process uses autocatalytic chemical reaction to deposit a reliable, repeatable coating of uniform thickness. This uniformity of deposition can, in some cases, eliminate the need for post-plate grinding.

Direct Formation of Q-Carbon Film on a Substrate

In an embodiment, a ferromagnetic Q-carbon thin film may be formed directly on wear surfaces of gears, bearings, and other moving components to protect against erosion, corrosion, and/or abrasion. In an embodiment, these films are formed by disposing a diamond-like amorphous carbon that is free of additional components on a substrate surface, e.g., only the diamond-like amorphous carbon is disposed on the substrate. A nanosecond laser is then applied to the diamond-like amorphous carbon, e.g., the substrate surface is scanned, to melt the diamond-like amorphous carbon in a super undercooled state. The substrate is then quenched and a Q-carbon single-crystal thin film is formed. In an embodiment, the film formed using this method may be from 0.4 μm to 20 μm thick. The Q-carbon may also be used to form a film via CVD or PVD directly on steel or WC—Co of a rotary drill or on reamer faces in order to increase tool life. This may be done in a similar fashion to what is described above, where the film is formed directly on a component either during manufacture at the original equipment manufacturer (OEM) or subsequently during refurbishment. In an embodiment, the parameters for forming Q-carbon from deposition f the diamond-like carbon by pulsed laser ablation as follows: KrF Excimer Laser, 248 nm Wavelenght, energy density 3-4 $J/cm^2$. To produce Q-carbon film coating (laser Annealing process), the parameters will be ArF Excimer laser with 193 nm, energy density 0.6-0.8 $J/cm^2$.

In an alternate embodiment using laser annealing, a substrate such as steel is polished using grit or another means and a multi-layer diamond-like-coating (DLC)/titanium (Ti) structure is deposited. This multilayer coating may comprise at least one bilayer of a layer of DLC and a layer of Ti. This structure is annealed using laser energy of at least 0.6 $J/cm^2$ to form the hardfacing.

In an embodiment, a 500 nm thick DLC when laser annealed forms a super undercooled layer of quenched carbon (Q-carbon) near the film-substrate interface, which breaks into a filamentary structure upon quenching. Our preliminary measurements of Q-carbon filaments embedded in DLC using nanoindentor measurements are in the range of 35 GPa compared to 21 GPa for the DLC, suggesting that Q-carbon is harder by over 60 pct compared to DLC.

Fabrication of Q-Carbon Coated PDC Cutters and Inserts

In an embodiment, a PDC cutter diamond layer is formed that comprises Q-carbon powder from 5 nm to 50 μm in size, and may be produced by the high temperature/high pressure (HT/HP) process. In an embodiment, the PDC mixture used to form the diamond layer may comprise 100% Q-carbon powder, 50/50 Q-carbon and μm-sized diamond particles, 90/10 Q-carbon micro-diamond particles, or other ratio between the Q-carbon and the μm-sized diamond particles as appropriate for various applications. In one embodiment, Q-carbon particles from 0.5 nm to 500 nm may be used without functionalized powder, e.g., without micro-sized diamond particles, to achieve a hardfacing of up to 4 mm thick.

In an embodiment, a PDC cutter is produced by a high pressure and high temperature process. A layer of powder mixture of Q-carbon/diamond and its catalyst metal powder at the bottom of a niobium cup or other transition metal cup is pressed adjacent to the face of cylindrical shape of cemented tungsten carbide (WC) bonded with cobalt. A second cup is reversed to form a capsule with the first cup to enclose the cemented carbide body and diamond powder mixtures. The subassembly is pressed through a die to tighten the contents becoming an enclosed can. In some case, e-beam Welding is applied to join the seams between two cups. Herein, typical cemented carbide contains tungsten carbide particles in the range of 1 to 25 um and cobalt content in 6 to 20 percent by weight. Q-carbon/diamond particle size is from 5 nm to 50 um, depending mechanical properties desired in PDC cutter application.

In one embodiment, Q-carbon films are deposited directly on steel or WC—Co of a rotary drill or on reamer faces to increase tool life. The procedure may include putting diamond-like amorphous carbon on the surface of to-be-deposited parts. Nanosecond laser can be used to scan the diamond-like amorphous carbon. Nanosecond laser heating can be confined to melt carbon in a super-undercooled state. By quenching the carbon from the super-undercooled state, Q-carbon single-crystal thin films are formed.

Q-Carbon-Based Cutting Tools

In another embodiment, the Q-carbon powder and/or composite powder may be used not as a coating but as the material from which a cutting tip is formed. That is, a Q-carbon cutting tip, which may comprise Q-carbon and/or other components as discussed herein, may be attached or formed (built up) on WC—Co inserts using in various cutting and machining operations. In another example, Q-carbon parts may be formed as separate components by pressing or other means and may be further processed by cutting and/or heat-treatment prior to being attached to a tool body. In an embodiment, the Q-carbon parts are coupled to the tool bodies via brazing, soldering, adhesives including epoxy, or combinations thereof. In some embodiments, this coupling may be such that the Q-carbon component can be removed and replaced.

In another embodiment, cutting tips made of Q-carbon material are formed on WC—Co inserts by additive manufacturing. This may comprise depositing amorphous diamond-like carbon, layer by layer, on the top of the insert and converting each layer to Q-carbon. Alternatively, a component of Q-carbon can be created by additive manufacturing and cut into a desired shape. The manufactured Q-carbon piece can be attached to the tool body by a permanent securing mechanism such as brazing, soldering, an adhesive such as epoxy, or the like. In an embodiment, a Q-carbon component may comprise a maximum diameter of 25 mm and may be a cylindrical, dome, or conical shape. In alternate embodiments, the component may comprise a cutting edge and/or have a semi-flat (curved or tapered) end and a blunt end to connect to a tool body. In still other embodiments, the maximum diameter may be less than 25 mm, for example, from 8 mm to 25 mm.

FIG. 1A is an image of an embodiment of a cross-section of a hardfacing, where the dark dots 106 are the particles of the Q-carbon material of the wear-resistant material. The Q-carbon material particles 106 are encapsulated within a matrix 108, which is made of matrix material(s) of the wear-resistant material. In one embodiment, the matrix 108 thickness may be in a range from 1 μm to 100 μm. The encapsulated particles, e.g., 106 coated in 108, are then blended with the low-melting-point matrix alloys 102 such as Ni—Si—B, Ni—Cr—B—Si—Fe, and deposited as hardfacing using laser, PTA, or a thermal spray. The layer thickness of the hardfacing on the substrate may be in a range of 0.5 mm to 3 mm. The matrix thickness of the hardfacing can be selected based on the desired improvement in wear resistance.

Figure 1B:
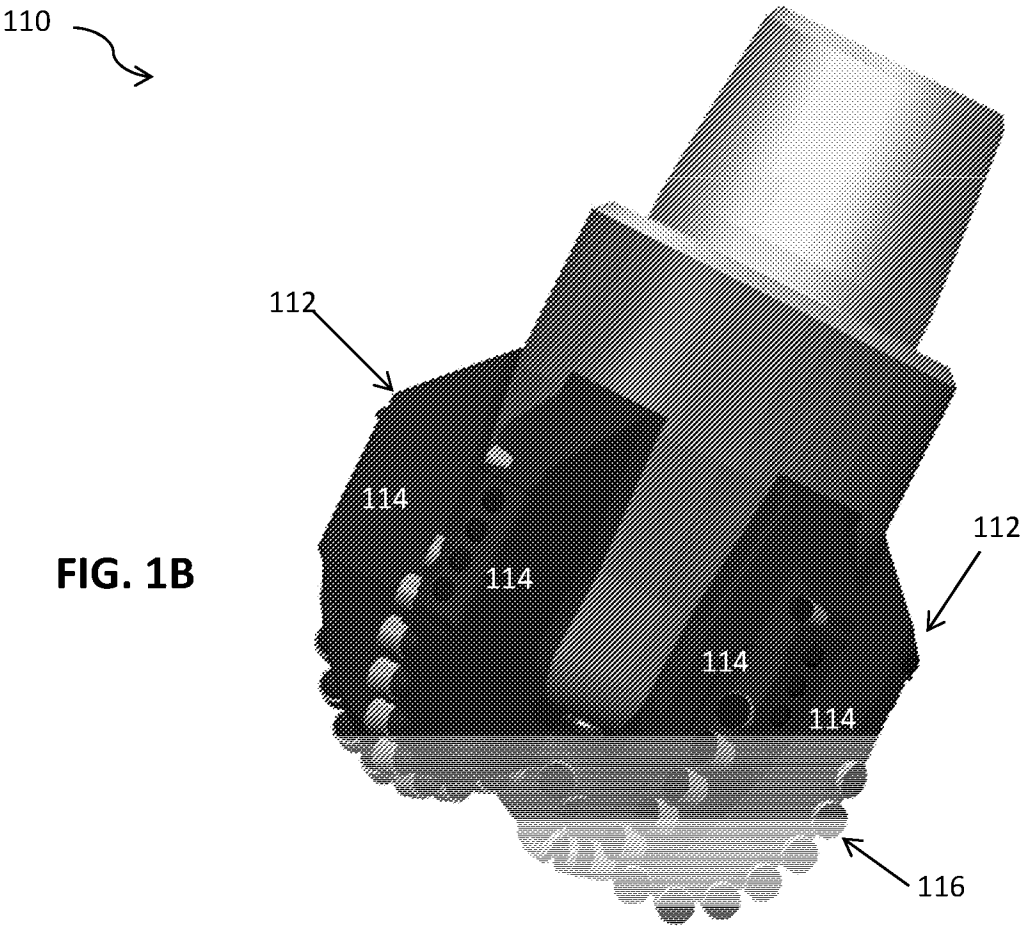
FIG. 1B is an illustration of a hardfacing applied to a drill bit according to embodiments of the present disclosure.

FIG. 1B shows a drill bit 110 with a plurality of blades 112. A hardfacing 114, indicated by the darkened areas 114, has been applied to the cutting surfaces of the blades 112, i.e., the surfaces of the blades 112 that carry a plurality of cutting elements 116 "cutters," using various methods discussed herein. In alternate embodiments, the drill bit 110 comprises the plurality of cutters 116 embedded in the blades 112. As shown, the cutters 116 are surrounded by the hardfacing 114. When the cutters 116 are being used to cut into formation, the hardfacing 114 rather than the surfaces of the blades 112 carrying the cutters 116 will be subject to abrasive wear, thereby protecting the blades 112 and extending the life of the drill bit. If the hardfacing 114 gets worn down, a new hardfacing 114 can be applied to the blades 112, e.g., the hardfacing can be refurbished instead of completely replacing the drill bit 110. This is expected to be cheaper than having to replace the whole drill bit 110. Hardfacing 114 may also be used on other areas of the drill bit 110 that are vulnerable to wear.

Figure 2B:
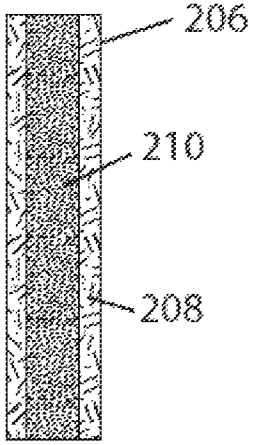
FIGS. 2A and 2B are schematic illustrations of hardfacing rods fabricated according to certain embodiments of the present disclosure.
Figure 2A:
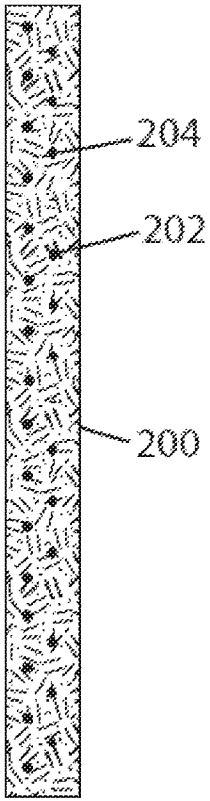

FIG. 2A shows an example of a hardfacing rod 200 with particles 202 of Q-carbon powder dispersed within a matrix 204 made of one or more low-melting matrix alloys. The hardfacing rods can be deposited as brazing rods onto preheated surfaces, such as surfaces of drill bits or other downhole tools, using a neutral oxy-acetylene flame, thereby forming hardfacing on the surfaces comprising the plurality of rods fabricated from the hardfacing material.

In another embodiment, the one or more low-melting matrix alloys is used to form a tube. Then, the Q-carbon powder is disposed within the tube to form a hardfacing rod. FIG. 2B shows an example of a hardfacing rod 206 with a tube 208 made of the matrix material(s) and the Q-carbon powder 210 within the tube. The matrix materials may comprise nickel- or cobalt-based matrix alloys, such as Ni—Si—B, Ni—Cr—B—Si—Fe, and Co—Cr—Ni; tungsten carbide/tungsten semicarbide ($WC/W_2C$) matrix; tungsten-carbide cobalt (WC/Co) matrix; chromium carbide ($Cr_3C_2$) matrix; silicon carbide (SiC) matrix; and nickel aluminate or cubic boron nitride. Although not shown, one or both ends of the tube may be capped with one or more matrix materials to prevent the Q-carbon powder 210 from falling out of the tube. In some embodiments, the Q-carbon powder may be coated against oxidation, as described above, prior to being disposed within the matrix tube.

Figure 2C:
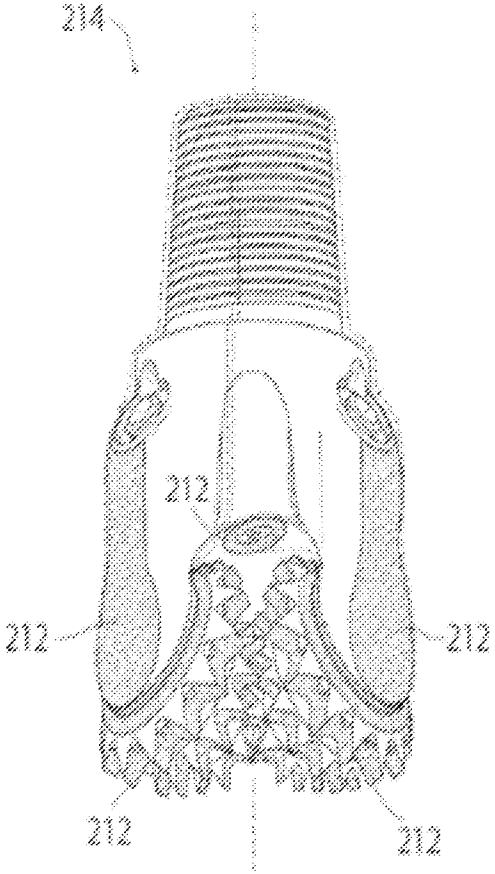
FIG. 2C is a schematic illustration of a roller cone bit with hardfacing fabricated according to certain embodiments of the present disclosure.

FIG. 2C shows an example of hardfacing 212 areas of a roller cone bit 214 where the hardfacing 212 may be formed by melting a hardfacing rod, e.g., hardfacing rod 200 in FIG. 2A or 206 in FIG. 2B, onto some or all of these areas. Thus, a hardfacing rod may be formed and coupled to another structure such as a drill bit, as shown in FIGS. 1B and 1C, and/or the hardfacing rod may be melted on to a surface as is shown in FIG. 2C.

Figure 3A:
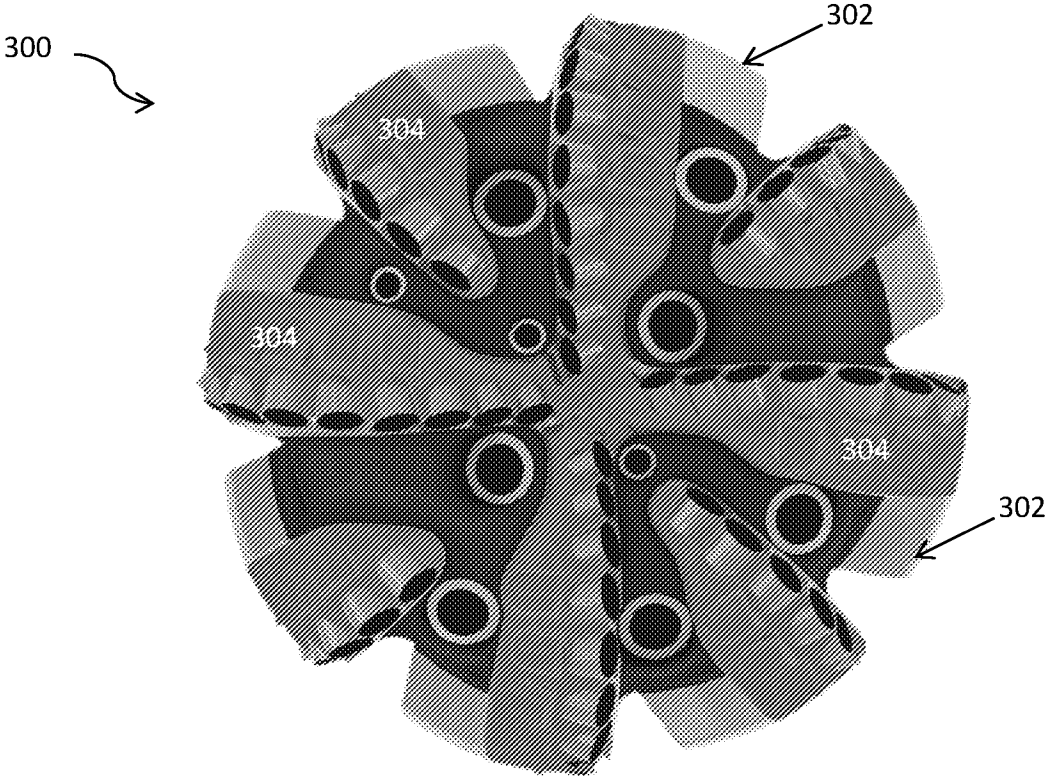
FIG. 3A is an illustration of a perspective view of a drill bit fabricated with hardfacing according to certain embodiments of the present disclosure.
Figure 3B:
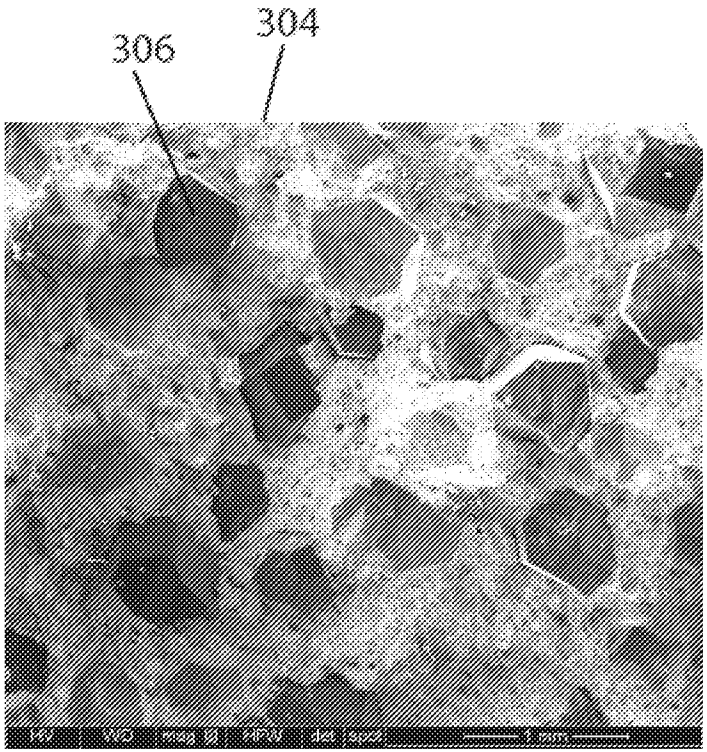
FIG. 3B shows a photomicrograph of an impregnated matrix fabricated according to certain embodiments of the present disclosure.

FIGS. 3A and 3B illustrate examples of drill bits formed via an impregnated Q-carbon matrix blend. The impregnated material blend includes Q-carbon powder and a metal carbide blend powder. In one embodiment, the metal carbide blend powder comprises a tungsten carbide blend powder including tungsten metal power and carbide powder. In some embodiments, the tungsten carbide blend powder may further include carbonyl iron powder to allow formation of tungsten carbide. The Q-carbon powder may have particle sizes in a range from 300 μm to 1000 μm. The impregnated material blend may further include binding materials such as methylcellulose and distilled water. The components of the impregnated material blend may be mixed together to form a paste. As discussed above, FIG. 3A shows a top view of an impregnated bit 300 with a plurality of regions of the impregnated hardcoating matrix 304 on a plurality of drill bit blades 302. The regions indicated as "304" comprising hardfacing are referred to herein as blade "tops" due to the method in which the drill bits may be employed in operation. FIG. 3B shows an image of cross-section of the impregnated matrix 304. The darker dots 306 are the particles of the Q-carbon powder, which in one example may range from 0.2 mm to 2 mm in diameter.

Figures 4A, 4B:
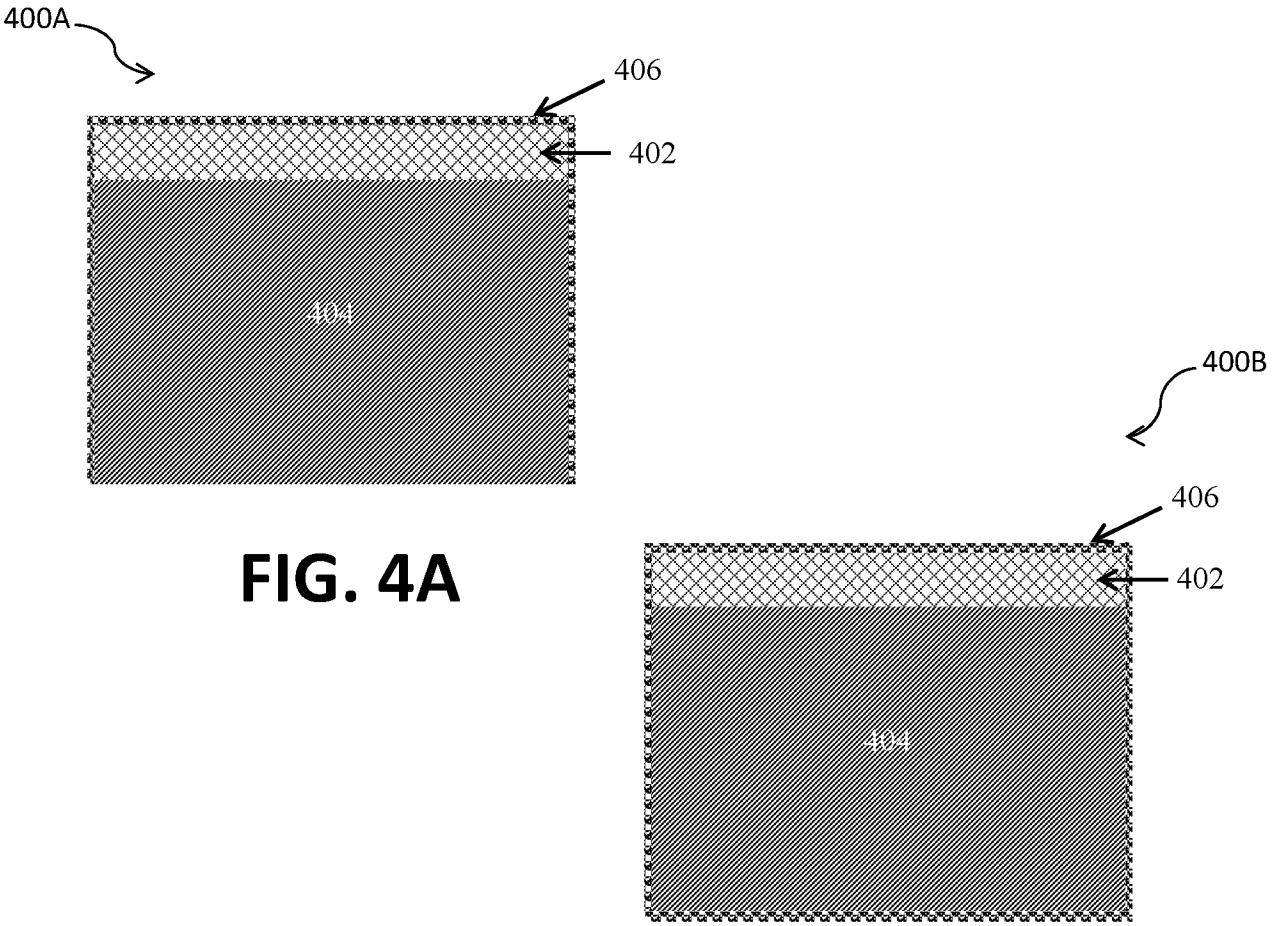
FIGS. 4A and 4B illustrate embodiments of PDC elements comprising a hardfacing according to certain embodiments of the present disclosure.

FIGS. 4A and 4B illustrate embodiments of PDC elements comprising a hardfacing according to certain embodiments of the present disclosure. While FIGS. 4A and 4B illustrate various thicknesses and relative thicknesses and sizes of the layers, it is to be understood that these are illustrative and that the layers may range in thickness according to various embodiments of the present disclosure. FIG. 4A shows an example polycrystalline diamond compact (PDC) cutter 400 having a diamond layer 402 on a substrate 404, typically made of steel or tungsten carbide and/or WC alloys that may comprise cobalt or other elements or alloys. A diamond material can be deposited on a single surface or side of the substrate 404 and sintered to form the diamond layer 402, and a hardfacing comprising Q-carbon 406, which may be referred to as a film, may be formed on the diamond layer 402, which may be referred to as a diamond table 402. Other types of PDC cutters or inserts may have a shape different than what is shown in FIG. 4A. Therefore, the diamond material is not limited to any particular shape of PDC cutter or insert, and FIG. 4B illustrates a partial cross-section schematic 400B that is similar to that of 400A in FIG. 4A. However, in FIG. 4B, the hardfacing comprising Q-carbon 406 is disposed on multiple surfaces of the substrate 404.

In on example, Q-carbon is synthesized on a tungsten carbide substrate for a PDC cutter or insert to yield higher toughness or performance of cutting tool. This will also reduce residual stress of PDC cutter/PDC inserts. In one embodiment, a diamond material for forming the diamond layer of a PDC cutter or insert, such as the diamond layer 402 shown in FIG. 4A, includes Q-powder with particles having sizes in a range 5 nm to 50 μm. In one embodiment, the Q-carbon powder may be made of Q-carbon nanodiamonds and/or Q-carbon microdiamonds that may range in size from 5 nm to 50 μm, or ranges within the range of 5 nm to 50 μm. In one embodiment, 100% of the volume of the diamond material is made of the Q-carbon powder. In another embodiment, the diamond material includes 50% to 90% by volume of the Q-carbon material and 10% to 50% by volume of a synthetic microdiamond not derived from Q-carbon. In one embodiment, the particles of the Q-carbon powder in the diamond material, the combination of which may be used to form the layer 406, may be coated with a thin layer, e.g., a nanolayer from 1 μm to about 50 μm, of a diamond crystallization catalyst such as Co, CoO, Ni, NiO, or Group VIII element or Group VIII element oxide. Such nanolayer coating may be employed in some embodiments to facilitate better diamond-to-diamond bonding and also improve the properties of the end product. The nanolayer may be applied to the Q-carbon diamond particles, e.g., to coat the entire surface of each particle, by an atomic layer deposition (ALD), CVD, PVD, or other processes.

In one embodiment, a Q-carbon thin film with ferromagnetic properties can be directly formed on wear surfaces to protect against erosion, corrosion or abrasion. The Q-carbon thin film 406 can be synthesized, as described earlier, using the desired wear surface as the substrate on which the synthesis is carried out. The thickness of the Q-carbon thin film 406 on the desired surface 404 may be 1 μm to 20 μm. While various examples of PDC cutters and drill bits are discussed herein, the wear surface to which the hardfacing and other Q-carbon based coatings are applied can be any surface of a downhole tool subject to erosion, corrosion, or abrasion.

In another embodiment, a PDC cutter is made entirely from Q-carbon powder with particles having sizes in a range from 0.5 μm to 55 μm to achieve improved thermal conductivity and higher abrasion resistance, without additional materials included in the Q-carbon powder.

Methods of Forming a Hardfacing on a Substrate

Figure 5A:
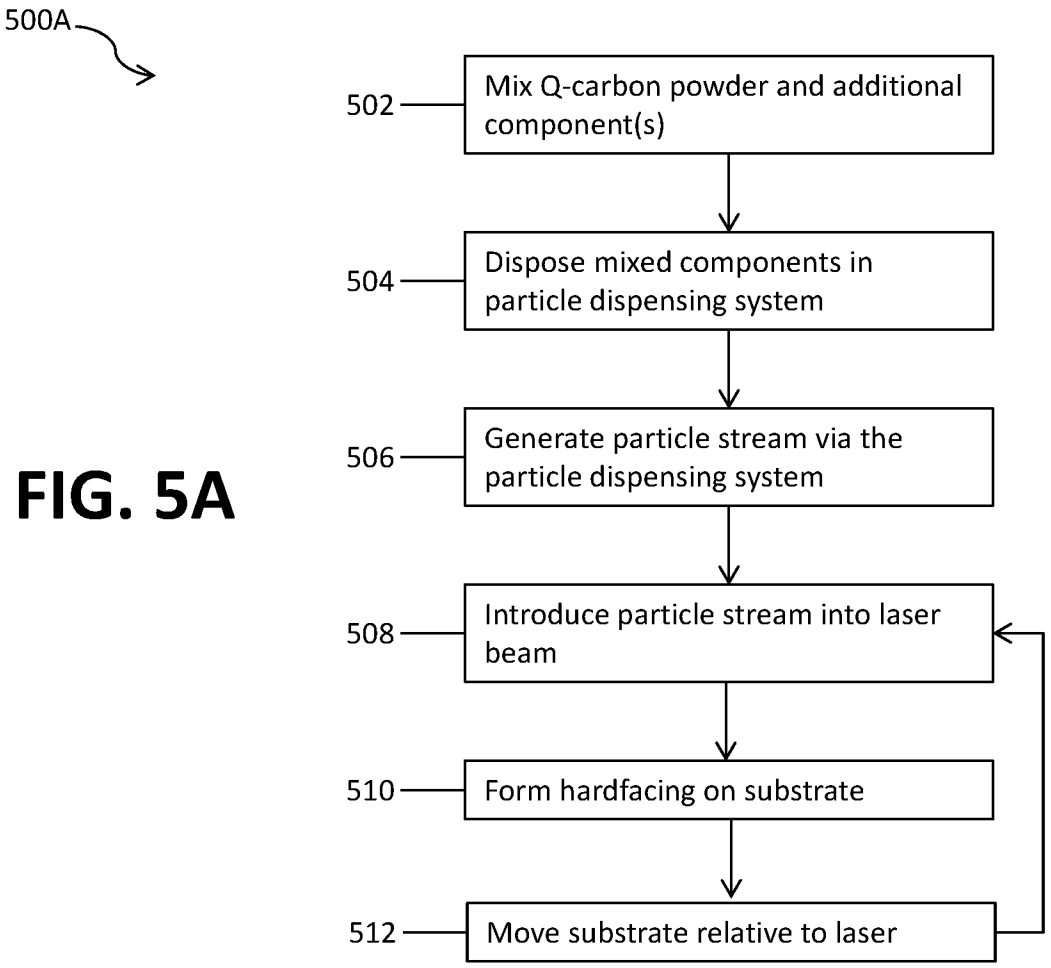
FIG. 5A is a flow chart that illustrates a method of forming a hardfacing on a substrate according to certain embodiments of the present disclosure.

FIG. 5A is a method 500A of forming a hardfacing on a substrate according to certain embodiments of the present disclosure. In an embodiment, the method 500A comprises mixing the powders of the wear-resistant material at block 502 and loading the powder mixture into a particle dispensing system at block 504. The mixing at block 502 may be carried out in a powder mixing tank under dry conditions. The powders are preferably thoroughly mixed at block 502, e.g., by rotating the powder tank several times, before the powder mixture is loaded into a particle dispensing system at block 504. The particle mixture is mixed at block 502 until it is homogenous such that the matrix particles coat each of the Q-carbon particles.

In an embodiment, the method 500A does not include block 502, and instead the particles dispensed in the system at block 504 comprise only Q-carbon particles from, for example, 0.2 nm to about 500 nm. The particle dispensing system generates a powder stream by means of nozzles and optionally by means of entraining gas at block 506. At block 508, the particle dispensing system introduces the powder mixture formed at block 504 as a particle stream into a laser beam. The laser beam is focused (aimed/targeted) at a substrate, which causes the powder mixture introduced into the laser beam to be melted on to the substrate to form a hardfacing at block 510. In an embodiment, the particle dispensing system is configured such that there is no segregation of the powder mixture during introduction of the powder mixture into the laser beam, e.g., the mixture's homogeneity is maintained. At block 512, the substrate may be moved in at least one direction relative to the laser, and blocks 508 and 510 may be repeated when the substrate is moved in order to form the hardfacing at block 510 on a plurality of areas on a substrate. These areas where the hardfacing is formed at block 510 are discussed herein and may be contiguous or discrete areas of a larger component. Moving the substrate relative to the laser beam at block 512 enables the melted powder to solidify and produce an area of overlaying hardfacing on the substrate. The metallurgical bonds formed between the overlaying hardfacing and the substrate thus provide high wear resistance.

Figure 5B:
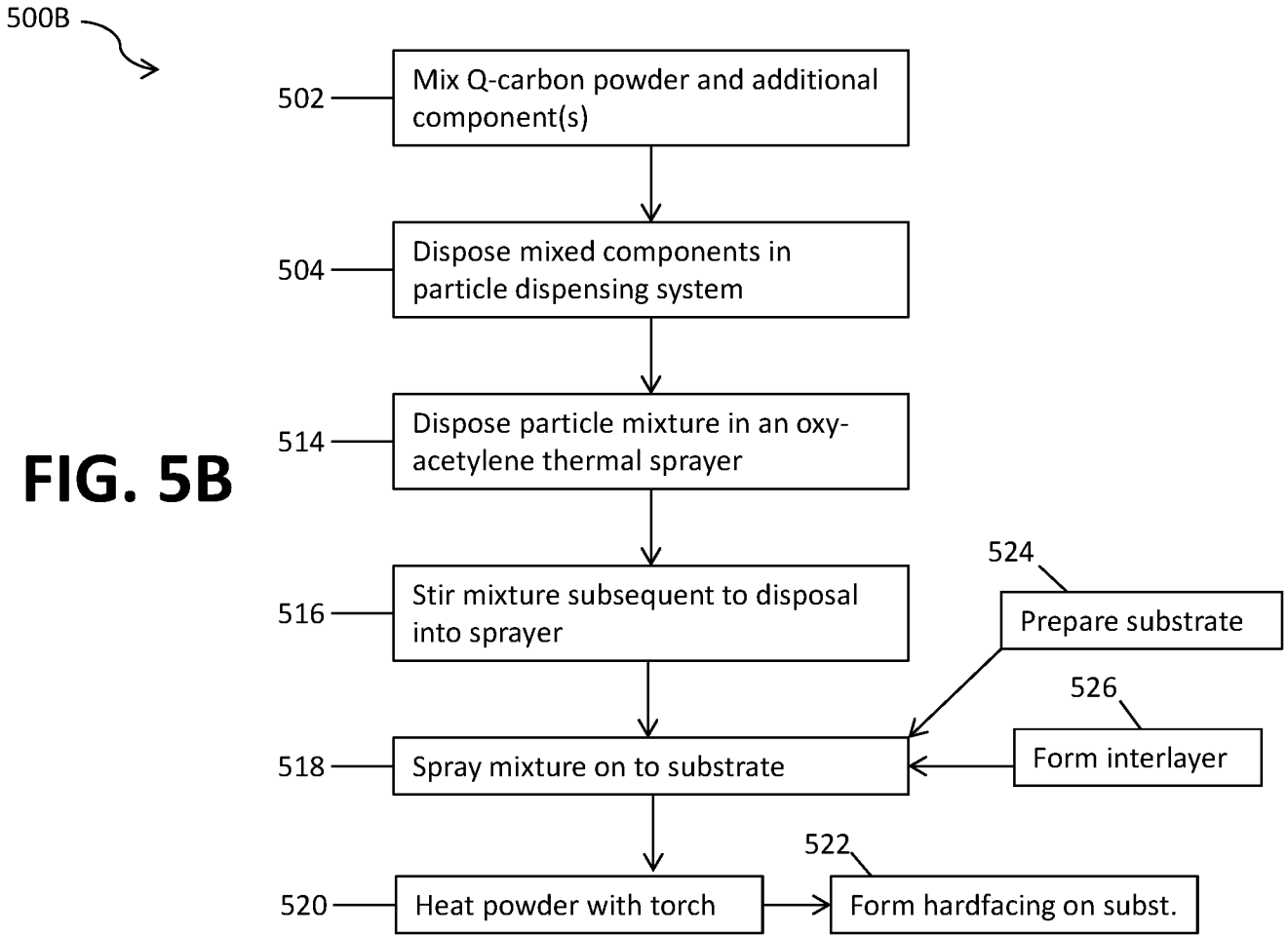
FIG. 5B is a flow chart that illustrates an alternate method of forming a hardfacing on a substrate according to certain embodiments of the present disclosure.

FIG. 5B illustrates an alternate method 500B of forming a hardfacing on a substrate by oxy-acetylene welding may comprise preparing a wear-resistant powder mixture as described above at blocks 502 and 504 but, instead of disposing the powder mixture into a particle dispensing system, the mixture is poured into the powder holder of an oxy-acetylene thermal spraying apparatus at block 514. In some embodiments, at block 516, the mixture is stirred again after being disposed into the apparatus at block 514 before using the apparatus to spray the mixture onto the substrate. At block 518, the powder mixture is sprayed on to the substrate using the oxy-acetylene thermal spraying apparatus. At block 520, subsequent to spraying the powder mixture on to the substrate at block 518, an oxy-acetylene torch is used to heat the substrate to a temperature at which the powder mixture fuses within itself and to the substrate to form the hardfacing at block 522. In some embodiments, at block 524, before spraying the powder mixture on to the substrate, at least one surface of the substrate may be prepared by grit blasting the surface, e.g., with silicon carbide grit, and pre-heating the surface. In one example, the surface s preheated to a temperature from about 300° F. to about 600° F. and the temperature is maintained during the formation of the hardfacing. In some embodiments, prior to spraying the mixture on to the substrate at block 518, an interlayer comprising a metal matrix powder may be sprayed on the substrate at block 526 to facilitate bonding between the wear-resistant material and the substrate and to help prevent oxidation of the substrate surface. The interlayer may comprise multiple depositions (layers) fabricated using an oxy-acetylene torch is used to heat the substrate to a temperature at which the powder mixture fuses within itself and to the substrate.

Figure 6A:
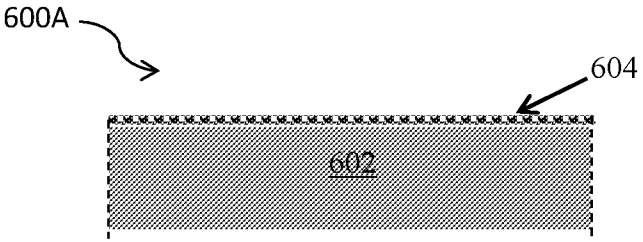
FIGS. 6A-6C illustrate schematic partial cross-sections of structures comprising hardfacing coatings according to certain embodiments of the present disclosure.
Figure 6B:
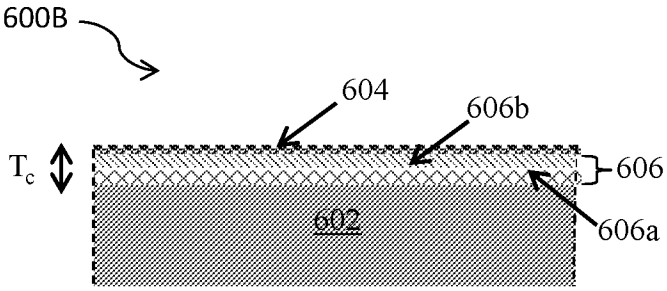
Figure 6C:
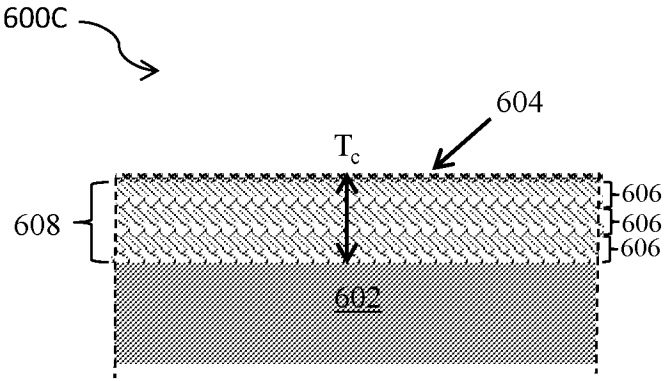

FIGS. 6A-6C illustrate schematic partial cross-sections of structures comprising hardfacing coatings according to certain embodiments of the present disclosure. FIG. 6A illustrates a structure 600A comprising a substrate 602 and a hardfacing 604 of Q-carbon or a Q-carbon composite or material, as discussed herein . . . . The substrate 602 may comprise WC, steel, or other substrates as appropriate for an end application. While the hardfacing 604 is disposed on one side of this partial cross-section 600A, in various embodiments, depending upon the geometry of the substrate 602 (e.g., is it a screw, drill bit, etc.), the hardfacing 604 may be formed on a plurality of surfaces of the substrate 602.

FIG. 6B illustrates a structure 600B comprising a substrate 602 and a hardfacing 604 of Q-carbon or a Q-carbon composite or material, as discussed herein. The substrate 602 may comprise WC, steel, or other substrates as appropriate for an end application. In this embodiment, the hardfacing is formed on an interlayer 606 that comprises a bilayer of a DLC layer **606*a* and a second layer 606*b* that may comprise metals or alloys including Ti and Ti-based alloys. While the hardfacing 604 and the interlayer 606 are disposed on one side of this partial cross-section 600B, in various embodiments, depending upon the geometry of the substrate 602 (e.g., is it a screw, drill bit, etc.), the hardfacing 604 and/or the interlayer 606 may be formed on a plurality of surfaces of the substrate 602. The coating thickness Tc of the embodiment in FIG. 6B may comprise the thickness of the interlayer 606 and the thickness of the layer 604**.

FIG. 6C illustrates a structure 600C comprising a substrate 602 and a hardfacing 604 of Q-carbon or a Q-carbon composite or material, as discussed herein. While FIG. 6B illustrates a single interlayer, FIG. 6C illustrates a plurality of interlayers 606 that form an interlayer 608 disposed in between the substrate 602 and the hardfacing 604. This embodiment is configured such that the total coating thickness Tc comprises the interlayer 608 and the hardfacing 604.

Method of Forming and Using a Hardfacing Rod

Figure 7:
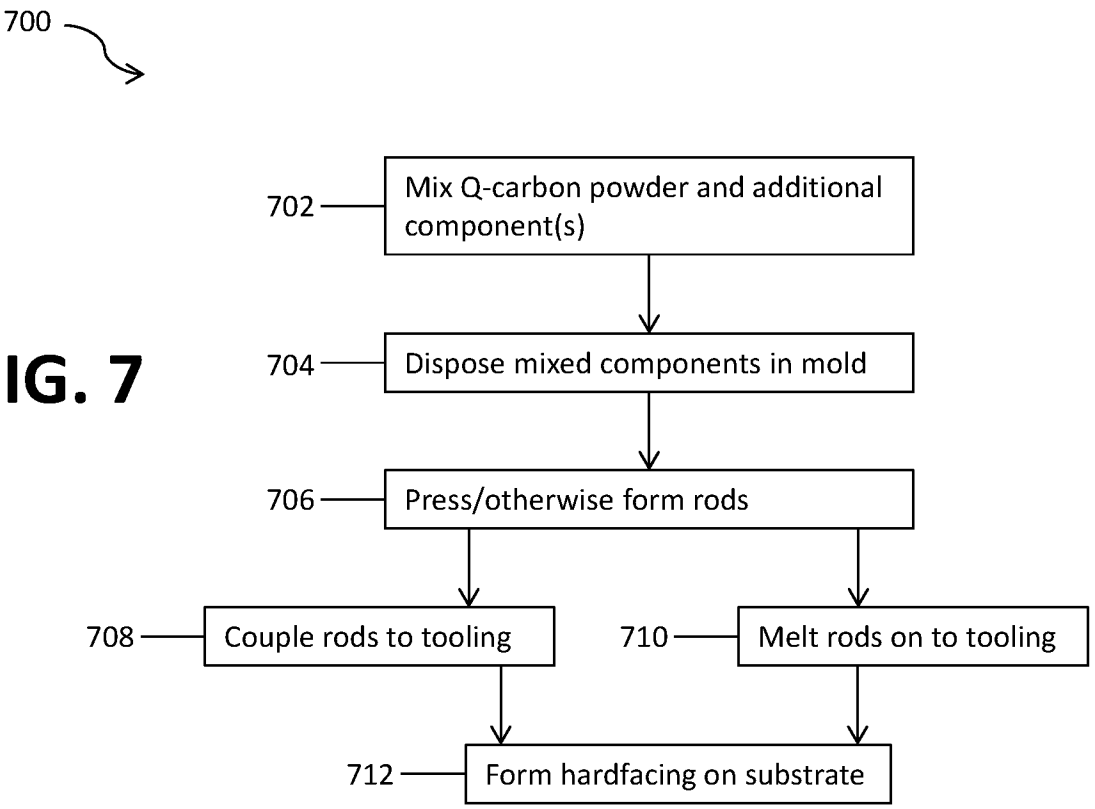
FIG. 7 is a flow chart that illustrates a method of forming and using a hardfacing rod according to certain embodiments of the present disclosure.

FIG. 7 illustrates a method 700 of forming a hardfacing rod. In the method 700, at block 702, a wear-resistant material is formed comprising Q-carbon powder and one or more low-melting matrix alloys, such as Ni—Si—B or Ni—Cr—B—Si—Fe such that the Q-carbon powder is dispersed within a matrix made of the one or more low-melting matrix alloys. In one embodiment, the Q-carbon powder has particle sizes in a range from 1 μm to greater than 1200 μm. In one embodiment, the Q-carbon powder may be at least 20% by volume of the wear-resistant material. In another embodiment, the Q-carbon powder may be 20% to 60% by volume of the wear-resistant material. In one embodiment, the one or more low-melting alloys may be 40% to 80% by volume of the wear-resistant material. In one embodiment, the particles of the Q-carbon powder may be coated with refractory materials, such as tungsten carbide, or other transition metals to protect the wear-resistant material against oxidation prior to disposing the Q-carbon into the metal matrix. The powder mixture is then disposed into a mold at block 704 and formed into a hardfacing rod using a suitable process, such as mechanically and/or thermo-mechanically processing the material, for example, by pressing, at block 706. It is appreciated that some molds may comprise more than one cavity such that a plurality of rods are formed at block 706. In some embodiments, at block 708, the hardfacing rods may be coupled to a drill bit as brazing rods using an oxy-acetylene torch/torch system, to produce a structure similar to what is illustrated in 110 FIG. 1B.

In other embodiments, at block 710, the hardfacing rods may be melted (welded) on to a substrate. In either embodiment, or in an embodiment where both blocks 708 and 710 are performed on the same piece of tooling such as a drill bit, a hardfacing coating is formed at block 712. In some embodiments, disposing the mixed components into the mold at block 704 comprises disposing a core of matrix material, for example as illustrated in FIG. 2B, and then disposing the mix from block 702 around this core. In still other embodiments, the method 700 does not include block 702, and instead the particles dispensed in the mold at block 704 only Q-carbon particles.

Figure 8:
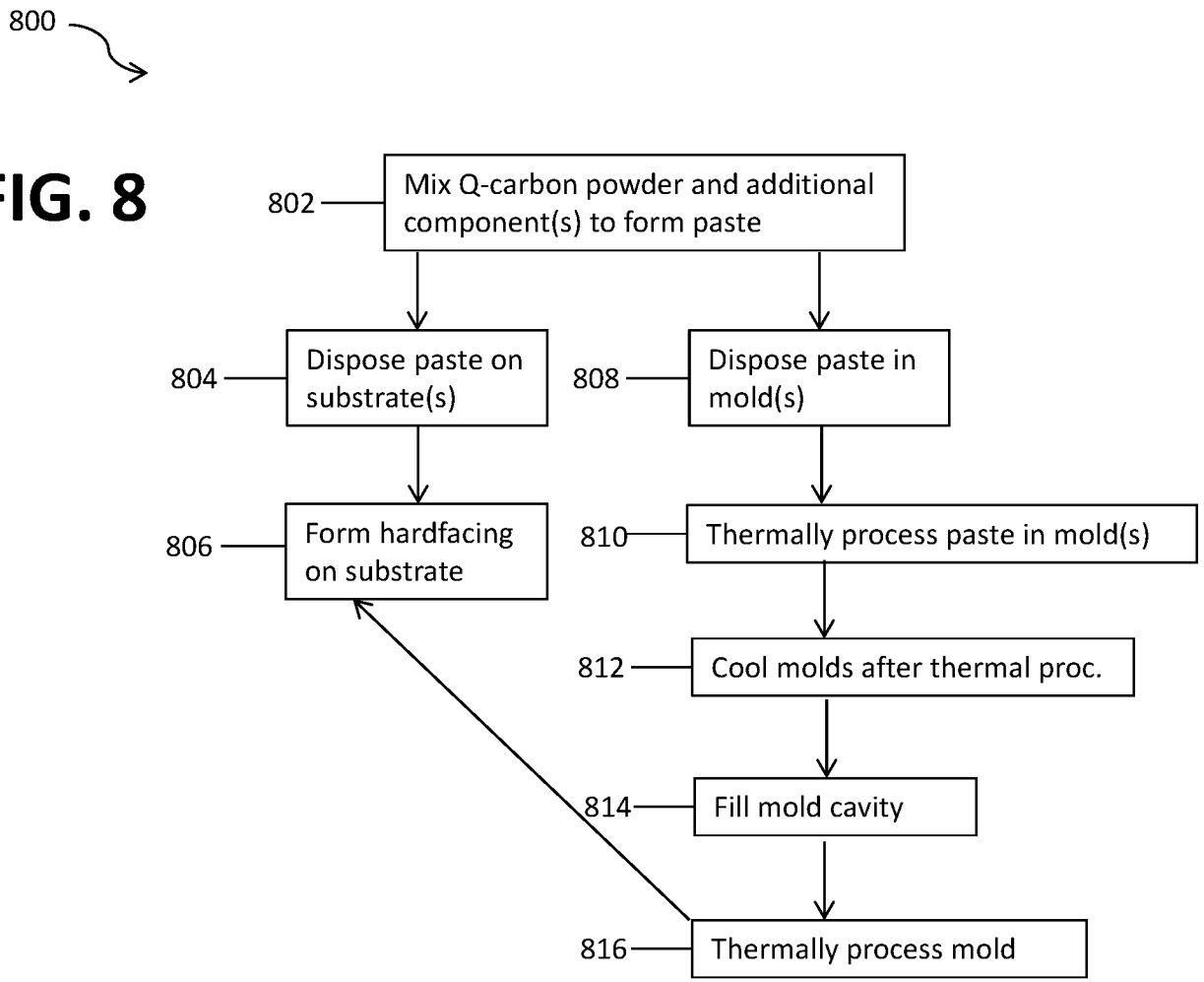
FIG. 8 is a flow chart that illustrates a method of forming an impregnate matrix blend to form a hardfacing coating according to certain embodiments of the present disclosure.

FIG. 8 illustrates a method 800 of forming an impregnate matrix blend to form a hardfacing coating. At block 802 of the method 800 impregnated matrix blend may be formed by mixing Q-carbon and at least one of tungsten carbide powder, methylcellulose, carbonyl iron, and distilled water to make the material for diamond impregnated cutting structures of drill bits, this material may be referred to as a "paste." In this example, a Q-carbon powder of 300 μm to 1000 μm in size may be used. At block 804, the mixed paste may be disposed on a portion of a bit blade such as a bit blade top to improve abrasion resistance via an infiltration method. At block 806, a hardfacing is formed on the areas of the substrate such as the blade tip where the paste is applied.

In an embodiment, the impregnated material blend formed at block 802 can be used to form an impregnated bit. In one example, the impregnated material blend in paste form as formed at block 802 is loaded into desired area or areas of a mold cavity at block 808. The mold is placed in an oven and desiccated, e.g., at 325° F. for 1 hour at block 810. In alternate embodiments, varying temperatures and times may be used depending upon the composition of the paste, the end use, and the desired component or thickness dimensions. The mold is removed from the oven at block 812 and allowed to cool to, e.g., less than 80° F. In an embodiment, a component from a drill bit such as the shank of a bit is supported in the mold cavity. In this example, at block 814, the remainder of the mold cavity is then filled with matrix powder, an infiltrant metal binder, such as a copper alloy, is placed in the mold. Then mold is then heated in a furnace at a temperature sufficient to melt the infiltrant metal powder and a time period sufficient to allow it to flow into and bind the powder matrix at block 816. This may be, for example, 2100° F. for 90 minutes. At block 806, subsequent to heating at block 816, the hardfacing is formed on the surface of the portion or portions of the drill bit that are disposed in the mold. In some embodiments, the hardfacing may be formed and then coupled to the drill bit via impregnation, and in alternate embodiments, the hardfacing may be formed in a single step where both the drill bit portions that are to be hardfaced and the Q-carbon powder and/or mix are placed in the mold and the powder forms the hardfacing directly on the drill bit surface(s).

Method of Forming a Q-Carbon Component

Figure 9:
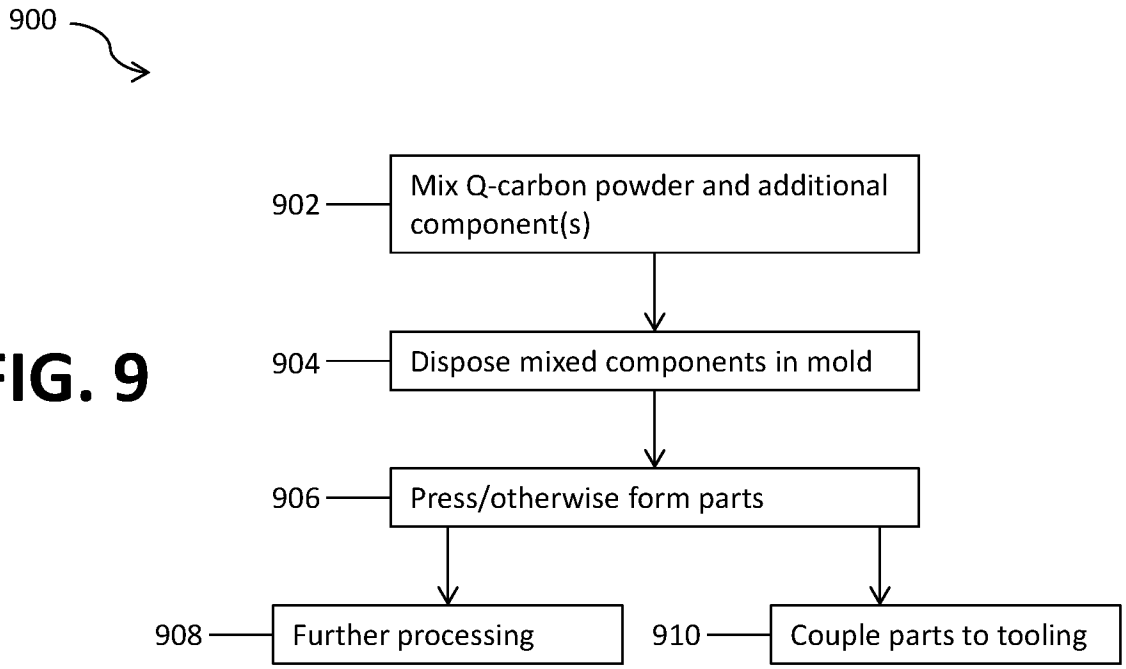
FIG. 9 is a flow chart that illustrates a method of fabrication and use of Q-carbon components.

FIG. 9 is a flow chart of a method 900 of forming and using a Q-carbon component. At block 902, a Q-carbon powder is prepared. As discussed above, the Q-carbon powder may be combined with various other materials such as a matrix material, and may be coated with particles of another material before blending with the matrix material. In alternate embodiments, the Q-carbon powder is used alone without additional components. At block 904, the Q-carbon and/or mix of Q-carbon and other components formed at block 902 are disposed in a mold. At block 906 the mold is at least one of thermally or mechanically processed to form a component. This component may be used as-is, or may be further machined and/or thermally processed at block 908, and may in some cases be coupled to tooling at block 910.

Doped DLC Coatings on Steel Substrates

Figure 10:
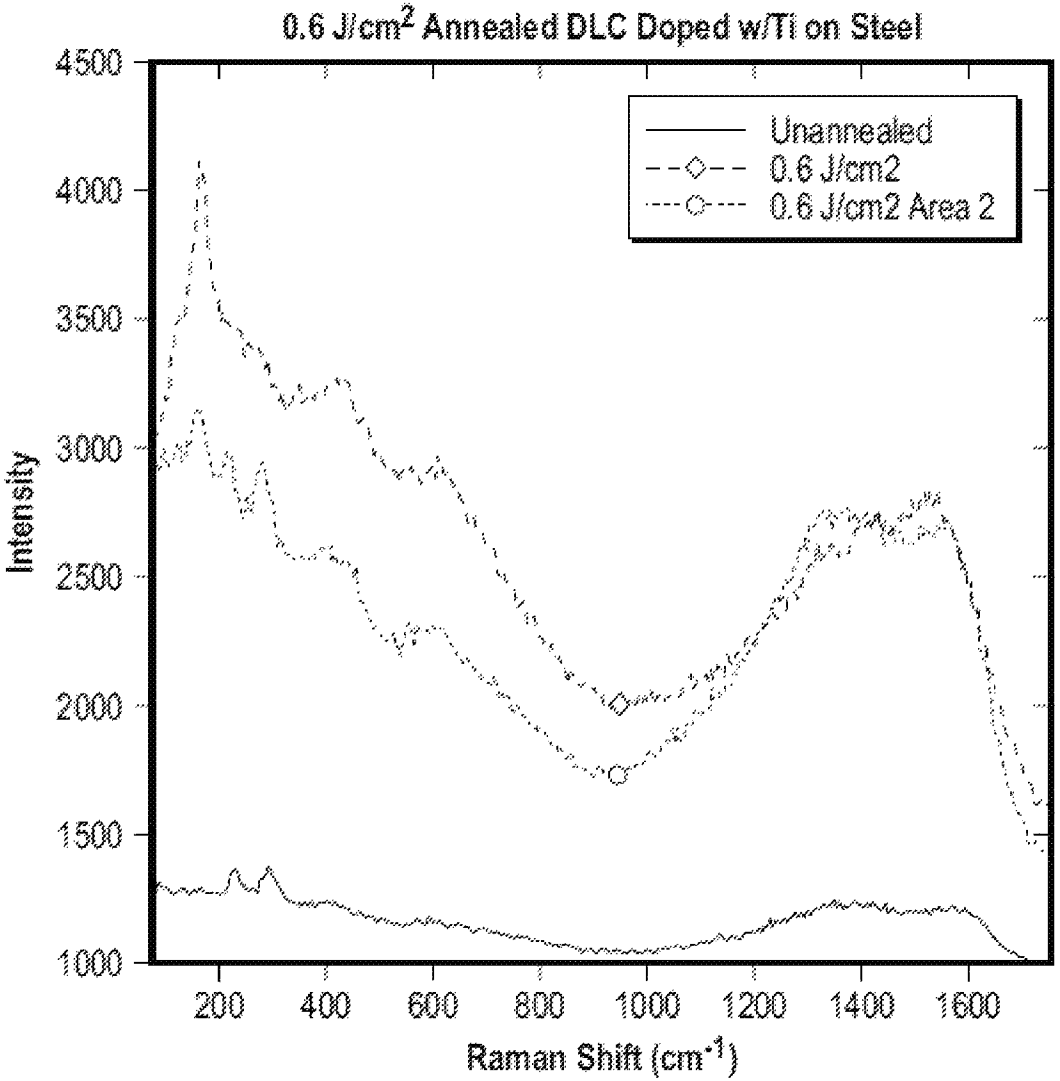
FIG. 10 is a Raman spectra graph of a wear-resistant coating fabricated according to certain embodiments of the present disclosure.

FIG. 10 is a Raman spectra graph of a wear-resistant coating fabricated according to certain embodiments of the present disclosure. In another embodiment, a wear-resistant coating may be formed on a steel substrate using DLC and a dopant such as titanium (Ti) or tantalum (Ta). The properties of the resulting coating may be similar to that of Q-carbon, as illustrated by the Raman spectra of FIG. 10. In one example, the application of laser energy at 0.6 J/cm$^2$ to a Ti-doped DLC which produced a coated film thickness of about 500 nm on a 4145 grade steel substrate. In another example, a laser at about 0.8 J/cm$^2$.

Figure 11B:
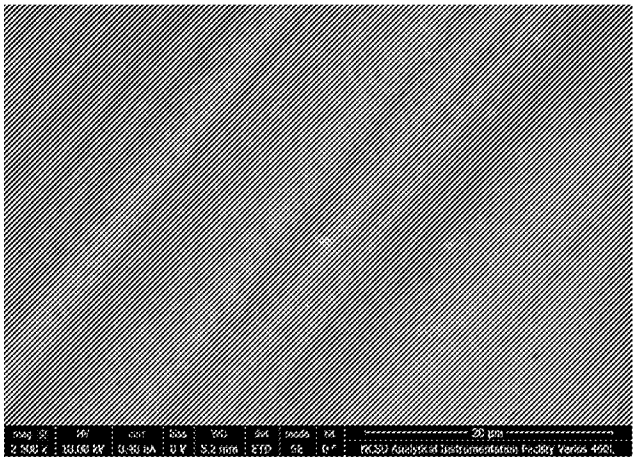
FIGS. 11A-11C are micrographs of samples of a wear-resistant coating fabricated according to certain embodiments of the present disclosure.
Figure 11A:
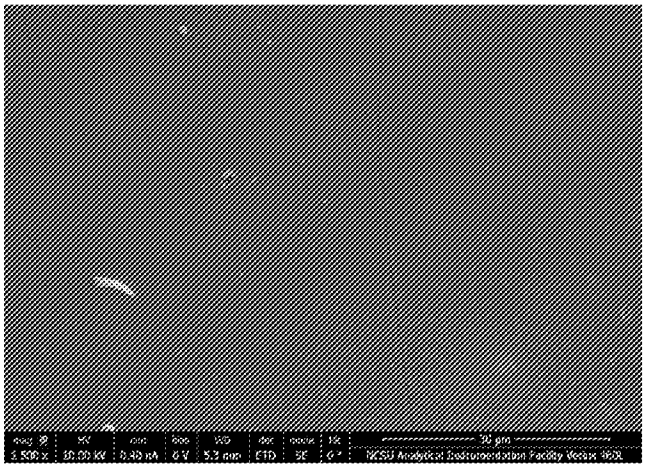
Figure 11C:
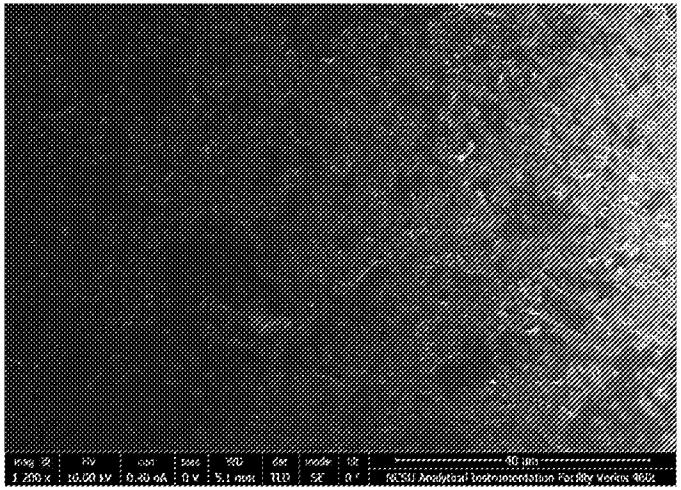

FIGS. 11A-11C are micrographs of samples of a wear-resistant coating fabricated according to certain embodiments of the present disclosure. FIGS. 11A and 11B are micrographs at 500× magnification with different scales that illustrate a Ti-doped DLC coating on steel for the samples that were used for the Raman spectra of FIG. 10. FIG. 11C is an illustration of the microstructure of the Ti-doped DLC coating on steel at 200× magnification.

While a limited number of exemplary embodiments of the invention have been described, those skilled in the art, having benefit of this disclosure, will appreciate that other embodiments can be devised which do not depart from the scope of the invention as defined herein. Accordingly, the scope of the invention is to be limited only by the accompanying claims.

While exemplary embodiments have been shown and described, modifications thereof can be made by one of ordinary skill in the art without departing from the scope or teachings herein. The embodiments described herein are exemplary only and are not limiting. Many variations, combinations, and modifications of the systems, apparatuses, and processes described herein are possible and are within the scope of the disclosure. Accordingly, the scope of protection is not limited to the embodiments described herein, but is only limited by the claims that follow, the scope of which shall include all equivalents of the subject matter of the claims.

The invention claimed is:

1. A component, comprising:

a tungsten carbide substrate;

a diamond layer formed on the tungsten carbide layer and comprising a plurality of diamond nanoparticles; and a Q-carbon layer formed on the diamond layer.

2. The component of claim 1, wherein the Q-carbon layer comprises 100% by volume Q-carbon particles.

3. The component of claim 1, wherein the diamond layer and tungsten carbide substrate comprise a PDC cutting element and the Q-carbon layer thickness is from about 0.5 μm to about 4 mm.

4. The component of claim 3, wherein the Q-carbon layer comprises Q-carbon particles from about 0.5 μm to about 500 μm.

5. The component of claim 3, wherein the Q-carbon layer comprises 90% by volume Q-carbon particles and 10% by volume synthetic micro-diamond particles not derived from Q-carbon.

6. The component of claim 1, wherein the Q-carbon layer is a film less than 50 μm thick.

7. The component of claim 1, wherein the Q-carbon layer comprises Q-carbon diamond particles encased in a first material comprising nickel (Ni), tungsten carbide (WC), cobalt (Co), or combinations thereof.

8. The component of claim 1, wherein the Q-carbon layer comprises Q-carbon diamond particles dispersed in a metal matrix comprising at least two of nickel (Ni), cobalt (Co), silicon (Si), boron (B), chromium (Cr), or iron (Fe).

* * * * *